US010989004B2

(12) United States Patent
Russell et al.

(10) Patent No.: US 10,989,004 B2
(45) Date of Patent: Apr. 27, 2021

(54) SHOCK AND AGITATOR TOOL

(71) Applicant: Arrival Oil Tools, Inc., Leduc (CA)

(72) Inventors: Jayson Russell, Calgary (CA); Laurier E. Comeau, Calgary (CA)

(73) Assignee: Arrival Oil Tools, Inc., Leduc (CA)

( * ) Notice: Subject to any disclaimer, the term of this patent is extended or adjusted under 35 U.S.C. 154(b) by 47 days.

(21) Appl. No.: 16/534,888

(22) Filed: Aug. 7, 2019

(65) Prior Publication Data

US 2021/0040808 A1 Feb. 11, 2021

(51) Int. Cl.

| | |
|---|---|
| ***E21B 31/00*** | (2006.01) |
| ***E21B 34/14*** | (2006.01) |
| ***E21B 28/00*** | (2006.01) |
| ***E21B 34/06*** | (2006.01) |

(52) U.S. Cl.

CPC ..... *E21B 28/00* (2013.01); *E21B 31/005* (2013.01); *E21B 34/142* (2020.05); *E21B 34/06* (2013.01)

(58) Field of Classification Search

CPC ..... E21B 28/00; E21B 31/005; E21B 34/14; E21B 34/142

See application file for complete search history.

(56) References Cited

U.S. PATENT DOCUMENTS

| | | | | |
|---|---|---|---|---|
| 3,465,820 | A | 9/1969 | Kisling | |
| 3,964,556 | A | 6/1976 | Gearhart et al. | |
| 4,064,937 | A | 12/1977 | Barrington | |
| 4,630,244 | A | 12/1986 | Larronde | |
| 4,967,844 | A | 11/1990 | Brooks et al. | |
| 5,730,249 | A | 3/1998 | Shimizu | |
| 5,890,537 | A | 4/1999 | Lavaure et al. | |
| 6,279,670 | B1 * | 8/2001 | Eddison | E21B 4/02 175/107 |
| 6,675,607 | B2 | 1/2004 | Tarutani et al. | |
| 6,866,104 | B2 * | 3/2005 | Stoesz | E21B 31/005 173/1 |
| 7,874,382 | B2 | 1/2011 | Püttmann et al. | |
| 8,167,051 | B2 | 5/2012 | Eddison et al. | |
| 8,327,945 | B2 | 12/2012 | Gette et al. | |
| 8,544,567 | B2 | 10/2013 | Comeau et al. | |
| 8,567,528 | B2 | 10/2013 | Comeau et al. | |
| 8,826,987 | B2 | 9/2014 | Watson et al. | |

(Continued)

OTHER PUBLICATIONS

Blackhawk Specialty Tools, "Brute 2 Storm Valve," http://blackhawkst.com/tools/brute-2-storm-valve/, last visited Jan. 31, 2019, 4 pages.

Challenger Downhole Tools, "Challenger Sidewinder," http://challengerdownhole.com/downhole-tool-products/challenger-sidewinder/, last visited Apr. 19, 2019, 3 pages.

(Continued)

*Primary Examiner* — Nicole Coy

(74) *Attorney, Agent, or Firm* — Schafer IP Law

(57) ABSTRACT

A shock and agitator tool assembly vibrates a drill string to overcome stick slip and other friction-based problems that may occur during directional drilling. The agitator tool portion of the assembly, which can be used without the shock tool, allows for controlled activation and deactivation of the agitator tool by the use of one or more darts pumped downhole. The darts can be retrieved with a wireline tool. When activated, the agitator portion creates alternating pressure pulses. These pulses cause axial movement of the drill string above the agitator. A shock tool is described which utilizes a telescoping mandrel to amplify the axial movement created by the agitator tool.

17 Claims, 11 Drawing Sheets

STAGE 3

(56) References Cited

U.S. PATENT DOCUMENTS

| | | | | |
|---|---|---|---|---|
| 9,598,923 | B2 * | 3/2017 | Gilleylen | E21B 7/24 |
| 9,624,728 | B2 | 4/2017 | Crowley et al. | |
| 2012/0193145 | A1 | 8/2012 | Anderson | |
| 2014/0090888 | A1 | 4/2014 | Smith et al. | |
| 2014/0190749 | A1 | 7/2014 | Lorenson et al. | |
| 2016/0032653 | A1 | 2/2016 | James et al. | |
| 2016/0281449 | A1 | 9/2016 | Lorenson et al. | |
| 2018/0051518 | A1 * | 2/2018 | Tonti | E21B 34/10 |
| 2018/0163495 | A1 * | 6/2018 | Kinsella | E21B 7/04 |
| 2018/0171719 | A1 | 6/2018 | Donald et al. | |
| 2018/0230750 | A1 | 8/2018 | Lorenson et al. | |
| 2018/0340388 | A1 | 11/2018 | Lorenson et al. | |
| 2019/0153820 | A1 * | 5/2019 | Lorenson | E21B 34/14 |

OTHER PUBLICATIONS

CT Energy Services Ltd., "SRD Ratler Series," https://www.ctenergyservices.com/products/srd-ratler-series/, last visited Apr. 19, 2019, 4 pages.

Drilformance, "Accelglide," Aug. 7, 2016, 1 page.

DrillingFormulas.Com, "What are differences between Full Opening Safety Valve (TIW valve) and Inside BOP valve (Gray Valve)?," http://www.drillingformulas.com/what-are-differences-between-full-opening-safety-valve-tiw-valve-and-inside-bop-valve-gray-valve/, Nov. 9, 2013, 20 pages.

Impulse Downhole Tools, "Friction Reduction," https://www.impulsedownhole.com/new-page, last visited Apr. 19, 2019, 3 pages.

National Oilwell Varco, "Agitator Systems," https://www.nov.com/agitator/, last visited Apr. 19, 2019, 9 pages.

* cited by examiner

PORTS CLOSED

PORTS OPEN

STAGE 3

SHOCK AND AGITATOR TOOL

TECHNICAL FIELD

The present invention relates to the field of directional drilling, and in particular to a shock and agitator tool for use in downhole drilling operations.

BACKGROUND ART

Directional drilling involves controlling the direction of a wellbore as it is being drilled. Directional drilling typically utilizes a combination of three basic techniques, each of which presents its own special features. First, the entire drill string may be rotated from the surface, which in turn rotates a drilling bit connected to the end of the drill string. This technique, sometimes called "rotary drilling," is commonly used in non-directional drilling and in directional drilling where no change in direction during the drilling process is required or intended. Second, the drill bit may be rotated by a downhole motor that is powered, for example, by the circulation of fluid supplied from the surface. This technique, sometimes called "slide drilling," is typically used in directional drilling to effect a change in direction of a wellbore, such as in the building of an angle of deflection, and almost always involves the use of specialized equipment in addition to the downhole drilling motor. Third, rotation of the drill string may be superimposed upon rotation of the drilling bit by the downhole motor. Additionally, a new method of directional drilling has emerged which provides steering capability while rotating the drill string, referred to as a rotary steerable system.

When drilling deep bore holes in the earth, sections of the bore hole can cause drag or excess friction which may hinder weight transfer to the drill bit, or cause erratic torque in the drill string. Frictional engagement of the drill string and the surrounding formation can reduce the rate of penetration of the drill bit, increase the necessary weight-on-bit, and lead to stick slip. These effects may have the result of slowing down the rate of penetration, creating bore hole deviation issues, or even damaging drill string components. These problems exist in all drilling methods including rotary drilling and when using a rotary steerable system. However, they are particularly pronounced while slide drilling where significant friction results from the lack of rotation of the drill string.

Friction tools are often used to overcome these problems by vibrating a portion of the drill string to mitigate the effect of friction or hole drag. These friction tools form part of the downhole assembly of the drill string and can be driven by the variations in the pressure of drilling fluid (which may be air or liquid, such as drilling mud) flowing through the friction tool. Accordingly, the operation or effectiveness of a friction tool—namely, the frequency and amplitude of vibrations generated by the friction tool—may be affected by the flow rate of drilling fluid pumped through the string. Controlling the vibrations thus may involve varying the flow rate of the drilling fluid at the surface, and in order to cease operation of the friction tool the flow of drilling fluid must be cut off at the surface. Varying or cutting off the drilling fluid flow, however, will impact the operation of the entire drill string.

Furthermore, running a friction tool during the entirety of a drilling operation is not always desirable. For instance, it may be unnecessary or undesirable to run the tool while the drill bit is at a shallow depth, within casing or cement, or at other stages of the drilling operation where the added vibration of the friction tool is problematic. During those stages, the drill string may be assembled without the friction tool. However, when a location in the bore hole is reached where the need for a friction tool is evident, pulling the downhole assembly to the surface to reassemble the drill string to include the friction tool and then returning the drill string to the drill point can consume several very expensive work hours.

SUMMARY OF INVENTION

A first aspect is a downhole agitator tool for generating controlled vibrations of a drill string that comprises a first dart that comprises a dart body, open for fluid flow through the first dart; a dart nose section having one or more openings for fluid flow through the first dart, coupled to the dart body; and a dart nozzle disposed in the dart body, configured for a predetermined amount of fluid flow restriction; a valve section, configured for vibration generation that comprises an outer housing; a driveshaft disposed radially interior to the outer housing, the driveshaft having a through bore and rotatable relative to the outer housing; a driveshaft cap body disposed on an end of the driveshaft, in which are formed a first plurality of ports; and a stationary rotary valve disposed radially exterior to the driveshaft cap body, in which are formed a second plurality of ports longitudinally aligned with the first plurality of ports; and a power section, coupled to the valve section that comprises a stator; a rotor, disposed radially interior to the stator and coupled to the driveshaft; and a dart catching unit, disposed on an uphole end of the inner mandrel that comprises a guide section forming a guide for receiving the first dart when pumped from uphole; and a locking collet coupled to the guide section and configured to retain the first dart upon engagement, wherein the power section rotor is stationary relative to the power section stator unless the first dart is engaged with the dart catching unit.

A second aspect is a shock and agitator tool assembly that comprises a shock tool that comprises an outer housing; an inner mandrel; and one or more Belleville springs configured to allow axial movement of the internal mandrel relative to the outer housing, wherein the one or more Belleville springs are configured for compression corresponding to a predetermined downhole load; and an agitator tool that comprises a first dart that comprises a dart body, open for fluid flow through the first dart; a dart nose section having one or more openings for fluid flow through the first dart, coupled to the dart body; and a dart nozzle disposed in the dart body, configured for a predetermined amount of fluid flow restriction; a valve section, configured for vibration generation that comprises an outer housing; a driveshaft disposed radially interior to the outer housing, the driveshaft having a through bore and rotatable relative to the outer housing; a driveshaft cap body disposed on an end of the driveshaft, in which are formed a first plurality of ports; and a stationary rotary valve disposed radially exterior to the driveshaft cap body, in which are formed a second plurality of ports longitudinally aligned with the first plurality of ports; and a power section, coupled to the valve section that comprises a stator; a rotor, disposed radially interior to the stator and coupled to the driveshaft; and a dart catching unit, disposed on an uphole end of the rotor that comprises a guide section forming a guide for receiving the first dart when pumped from uphole; and a locking collet coupled to the guide section and configured to retain the first dart upon engagement, wherein the power section rotor is stationary relative to the power section stator unless the first dart is engaged with the dart catching unit.

A third aspect of the disclosure is a method of controlling a downhole agitator tool that comprises flowing drilling fluid through a bore of the agitator tool; pumping a first dart downhole; engaging the first dart with a dart catching region of the agitator tool; reducing drilling fluid flow through the bore by a nozzle of the first dart; engaging a power section of the agitator tool responsive to engaging the first dart with the dart catching region of the agitator tool; and rotating a rotary valve of the agitator tool by the power section, opening and closing ports of the rotary valve, causing vibrations in the agitator tool at a predetermined frequency.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
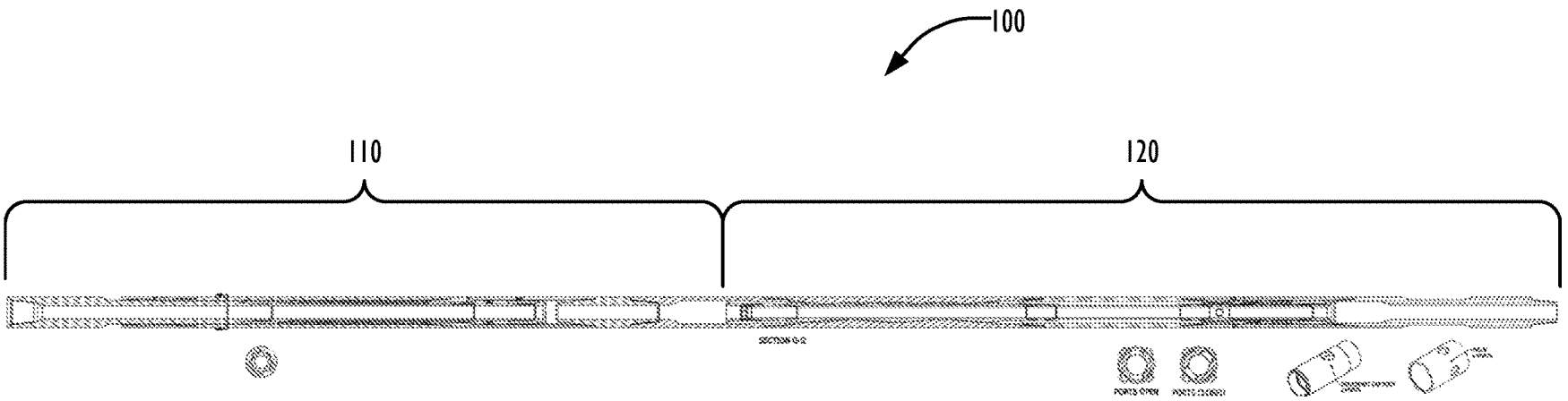
FIG. 1 is a plan view of a shock and agitator tool assembly according to one embodiment.

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts are understood to reference all instance of subscripts corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one."

The term "or" means any of the alternatives and any combination of the alternatives, including all of the alternatives, unless the alternatives are explicitly indicated as mutually exclusive.

The phrase "at least one of" when combined with a list of items, means a single item from the list or any combination of items in the list. The phrase does not require all of the listed items unless explicitly so defined.

In this description, the term "couple" or "couples" means either an indirect or direct connection. Thus, if a first device couples to a second device, that connection may be through a direct connection or through an indirect connection via other devices and connections. The recitation "based on" means "based at least in part on." Therefore, if X is based on Y, X may be a function of Y and any number of other factors.

A downhole agitator tool is described below that utilizes pressure pulses and an accompanying shock tool to translate pressure changes into axial movement thereby causing vibration of the drill string. The disclosed tool incorporates a through bore throughout the entire tool measuring 2" or greater, which allows for the retrieval of some Measurement While Drilling (MWD) tools and allows for usage of free point and backoff equipment to facilitate removal of stuck drill strings. The disclosed tool does not require special equipment, such as a safety joint, to be installed in the drill string. However, a safety joint may be included if required for the operator's other equipment.

In one embodiment darts may be pumped downhole to activate the operation of the tool selectively. The dart lands in a dart catcher at the top of a rotor of the tool and restricts flow through the bypass, thereby causing flow to go between the rotor and stator. This flow path causes the assembly to rotate and activates a control valve. The darts may incorporate different sized nozzles to allow for fine tuning of the pulse frequency and pulse amplitude. The darts may be retrieved if necessary, using wireline or tubing fishing techniques. If for any reason an operator wants to modify the pulse frequency, another dart can be launched that causes a change in the frequency or enables operators to maintain the frequency they have previously been running under new flow parameters. As lateral sections of drill pipe get longer, standpipe pressure issues can occur and often the flowrate has to be reduced. In that situation, a second dart may be launched to maintain or increase the pulse frequency at the reduced flowrate.

When in standby mode, flow proceeds through the bore of the power section, past (but not through) the control valve and out the bottom of the tool. This reduces wear on the tool components, reduces standpipe pressure and allows the operator to decide when they want the tool to start vibrating the drill string.

When in operational mode, the tool functions using a downhole power section with a rotating cap that has radial ports. This cap rests within a carbide sleeve that has a predetermined number of radial ports. Rotation of the cap thus causes an alternating flow restriction that creates an alternating pressure pulse. The nozzle in the dart allows for control of the pulse size and frequency. Further, this nozzle allows for protection against an overly aggressive pulse.

Should the restriction at the valve be too tight, flow will instead flow through the rotor, protecting other tools and equipment on the rig.

In one embodiment, the tool uses a robust polycrystalline diamond compact (PDC) bearing assembly that significantly reduces the required maintenance on the tool and provides great reliability.

To complement the pulsing tool, a double-acting shock tool may be included in a downhole assembly. In one embodiment, the shock tool incorporates Belleville springs and a telescoping mandrel. The geometry of the tool is so designed such that changes in pressure cause the tool to extend and contract which imparts an axial motion on the adjacent drill string. This motion breaks static friction, which improves weight transfer, reduces stick-slip, and improves drill string dynamics. When assembled with the pulse tool, the shock tool amplifies the pulses produced by the pulse tool. The shock tool maximizes the pump open area and the properties of the Belleville spring stack are tuned for use with the pulse tool. The spring configuration may be adjusted on surface to modify the axial movement of the mandrel.

Turning now to FIG. 1, an overview of a shock and agitator tool assembly 100 is illustrated in a plan view according to one embodiment. A shock tool 110 and an agitator tool 120 are coupled to form the shock and agitator tool assembly 100, as illustrated in more detail in FIGS. 2-4 and described below. In one embodiment, the tool assembly has a 5¼ outer diameter (OD) with threads provided for connection to other sections of drill string, but other embodiments may use other diameters.

Figure 2:
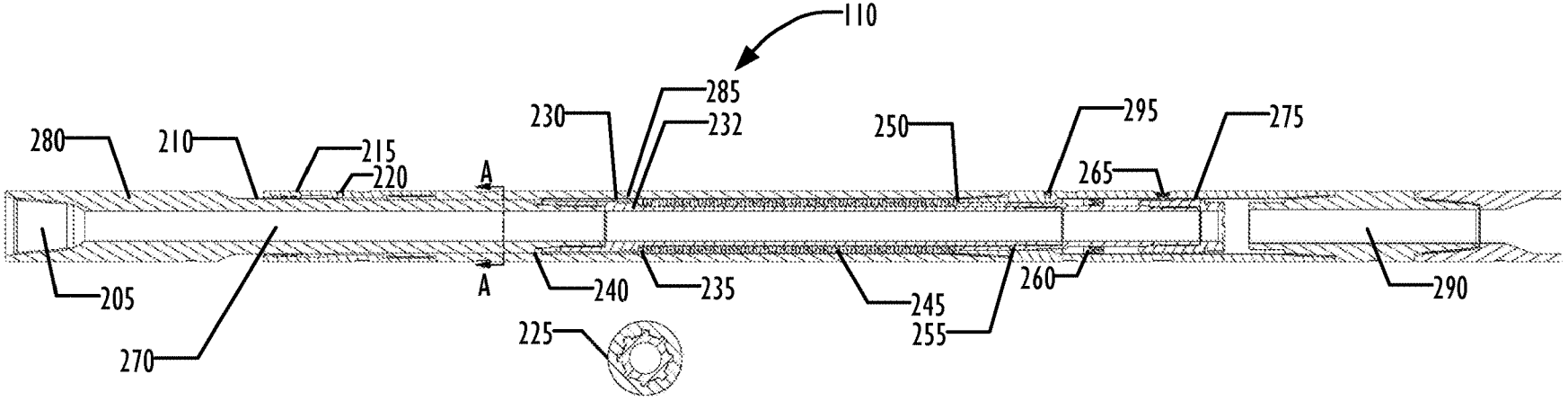
FIG. 2 is a plan view of a shock tool of the shock and agitator tool assembly of FIG. 1 according to one embodiment.

FIG. 2 is a detailed view of the shock tool 110 of the shock and agitator tool assembly 100 of FIG. 1 according to one embodiment. The shock tool 110 comprises a double-acting shock tool that imparts an axial motion to drill string that is adjacent to the shock tool 110. This motion breaks static friction, which improves weight transfer, reduces stick slip, and improves drill string dynamics.

The shock tool 110 is designed for threaded connection to the drill string using box thread section 205. An open bore 270 maximizes the open volume for fluid flow through the shock tool 110. In operation, a first mandrel 280 moves longitudinally relative to an outer housing 285, imparting the axial motion to the adjacent drill string.

A polished carbide seal outer surface area 210 provides a reduced friction surface for relative movement between first mandrel 280 and outer housing 285. An upper seal assembly 215 seals between the first mandrel 280 and outer housing 285, preventing fluid flow between them. The first mandrel, as shown in cross-section 225 taken at line A-A, may be formed with splines or other anti-rotation elements to allow transmission of torque from the drill string through the first mandrel 280 to the outer housing 285, preventing rotation of the first mandrel 280 relative to the outer housing 285.

A spring sleeve 230 surrounding a second mandrel 232 coupled to the first mandrel 280 provides axial loading from a collection of Belleville springs 245 between mandrels and housings. The Belleville springs 245 are configured to allow spring compression under expected downhole loads. An upper spring load surface 235 provides axial loading when the shock tool 110 is in compression, and an upper spring load surface 240 provides axial loading when the shock tool 110 is in tension. A lower spring load surface 255 provides axial loading when the shock tool 110 is in tension. A lower spring load surface 250 provides axial loading when the shock tool 110 is in compression. Although described in terms of Belleville springs, other types of springs can be used as desired.

A balance piston 260 compensates for oil expansion and reduces pressure at the moving seals of the sealed area 275. Fill ports for the oil chamber are located at 220 and 295. A vent port 265 provides venting to the outside of the shock tool 110, so that fluid pressure through the vent port 265 on the sealed area 275 allows changes in pressure in the fluid internal to the shock tool 110 to open or lengthen the shock tool 110, resulting in axial movement of the first mandrel 280 relative to the outer housing 285, resulting in axial movement of the connected drill string.

A coupling 290 allows coupling the shock tool 110 to the agitator tool 120.

Figure 3:
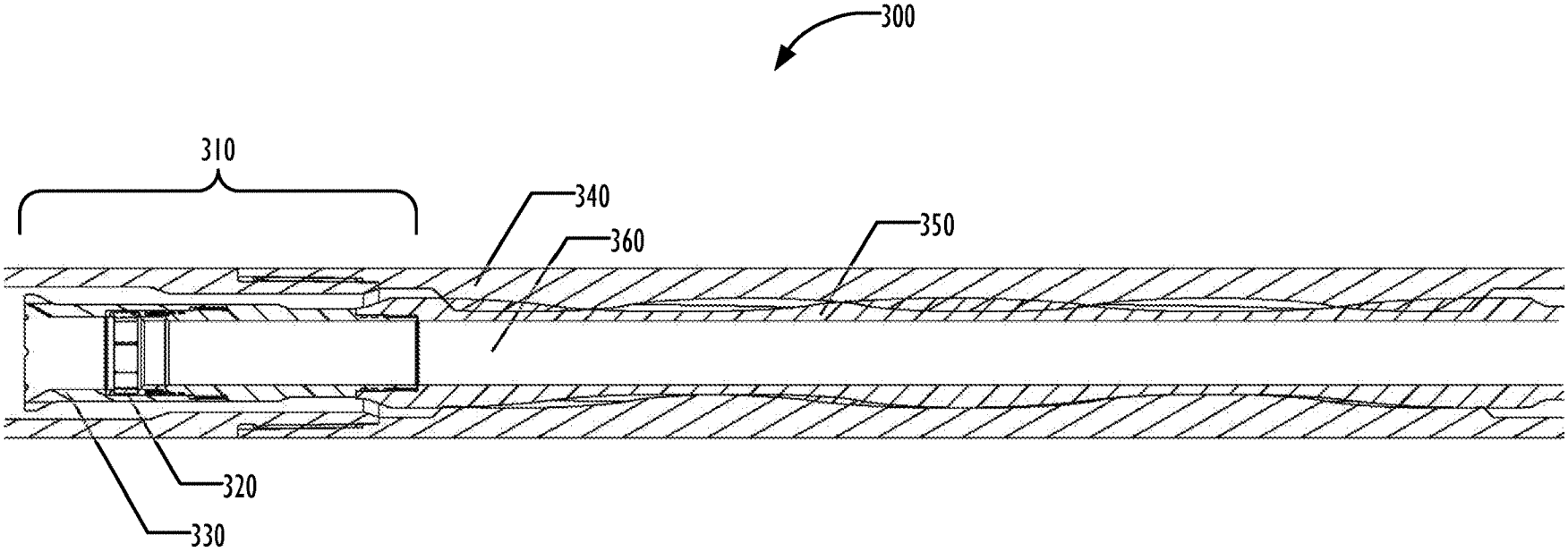
FIG. 3 is a plan view of a power section of an agitator tool of the shock and agitator tool of FIG. 1 according to one embodiment.

FIG. 3 is a plan view illustrating details of a power section 300 of the agitator tool 120. The power section 300 provides rotation to the agitator tool 120. A dart catching region 310 is formed at an uphole end of an inner mandrel 350 for catching control darts that can be dropped downhole to control the agitator tool 120. The dart catching region comprises a guide section 330 shaped to guide darts into the dart catching region. Locking collets 320 engage with a dart (not shown in FIG. 3) to retain the dart but are configured to release when a predetermined target pull force is reached, allowing the dart to be recovered back uphole. When the dart is not engaged with the dart catching region 310 and locking collets 320, drilling fluid passes through the bore 360 of the agitator tool and does not activate the rotary valve 440 (as illustrated in FIG. 4 and described below). In this mode, the agitator tool 120 remains in standby, for times when there is no need for or desire for the agitation of the drill string. In one embodiment, the bore 360 has a diameter of at least 2" (approximately 5 cm), but other embodiments may have different diameters. The outer housing 340 and inner mandrel 350 form a power section, with the outer housing 340 being the stator and the inner mandrel 350 being the rotor. When the dart is engaged with the dart catching region 310 and locking collets 320, the agitator tool 120 drilling fluid is forced to flow between the outer housing 340 and the inner mandrel 350, causing the inner mandrel 350 to rotate relative to the outer housing 340 because of configuration of the outer surface of the inner mandrel 350 and the inner surface of the outer housing 340. This rotation powers the valve section 400 of the agitator tool 120 as described below.

Figure 4A:
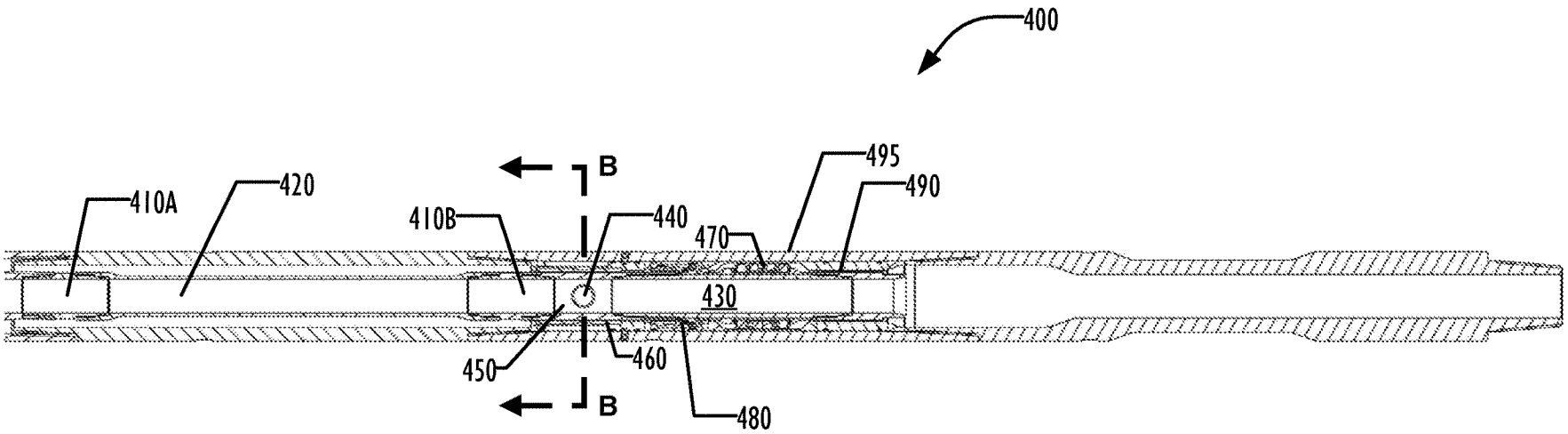
FIG. 4A is a plan view of a valve section of the agitator tool of the shock and agitator tool of FIG. 1 according to one embodiment.
Figure 4E:
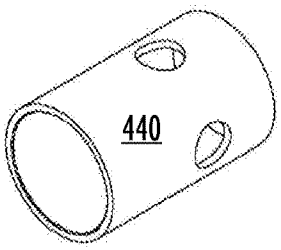
FIG. 4E is an isometric view of the rotary valve of FIG. 4A according to one embodiment.
Figure 4D:
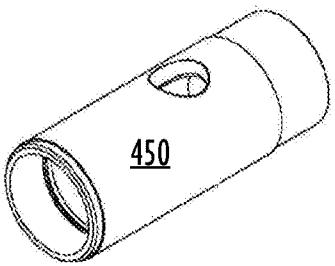
FIG. 4D is an isometric view of the driveshaft cap body of FIG. 4A according to one embodiment.

Turning now to FIG. 4A, a plan view illustrates a valve section 400 of the agitator tool 120 according to one embodiment. The valve section 400 may be flexibly connected to the power section 300 by couplings 410A and 410B and a flex shaft 420, allowing eccentric motion of inner mandrel 350 relative to valve 440, while maintaining rotary motion driven by the power section 300. A driveshaft cap body 450, illustrated in more detail in FIG. 4D, is coupled between coupling 410B and driveshaft 430. A stationary rotary valve 440, illustrated in more detail in FIG. 4E, is disposed radially exterior to the driveshaft cap body 450. As illustrated in FIGS. 4A-4E, driveshaft cap body 450 has 2 ports, and rotary valve 440 has 4 ports, but other numbers of ports can be used in each of the driveshaft cap body 450 and rotary valve 440 as desired. The ports of the rotary valve 440 are longitudinally aligned with the ports of the driveshaft cap body 450.

Figure 4C:
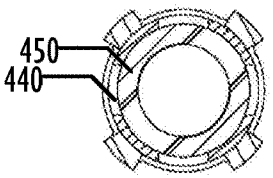
FIGS. 4B-4C are cross-sectional views of a driveshaft cap body and valve of the valve section of the agitator tool of FIG. 4A according to one embodiment.
Figure 4B:
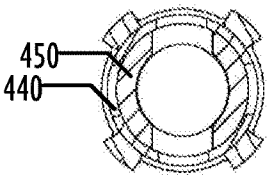
Figure 5:
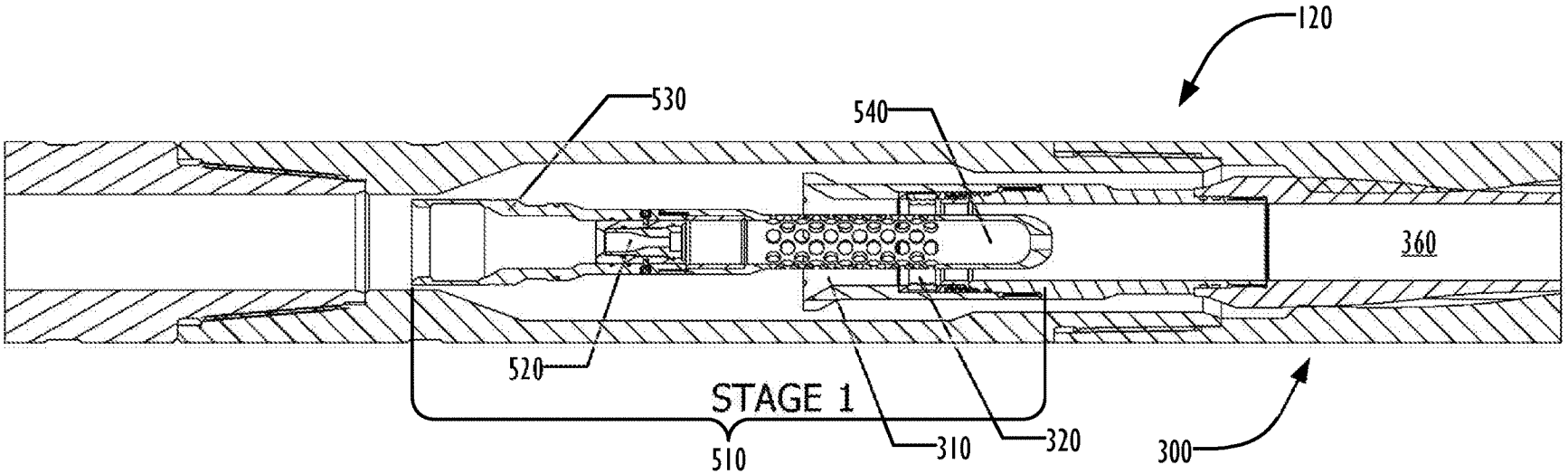
FIGS. 5-9 are a plan views illustrating use of a dart for activating the agitator tool of FIG. 4A according to one embodiment.

As illustrated in FIGS. 4B-4C, taken at a cross-section of the agitator tool 120 at line B-B, rotation of the driveshaft cap body 450 within the rotary valve 440 alternately opens and restricts passage through the ports at a frequency determined by the rotation of the power section 300 described above. This opening and restricting of the ports causes fluid pressure pulses, causing the valve section 400 to vibrate at a frequency corresponding to the rotation of the power section 300.

The carbide valve 440 acts as an upper radial bearing for the driveshaft 430 and driveshaft cap body 450. Similarly, a lower carbide radial bearing 490 provides support for the downhole end of the driveshaft 430. A high-pressure flow restrictor 480 disposed between the driveshaft 430 and outer housing 495 prevents valve bypass and protects the lower carbide radial bearings 490 from washout. A thrust bearing 470 positioned in the middle of the driveshaft 430 permits rotation of the driveshaft 430 while supporting an axial load. In one embodiment, the thrust bearing 470 is a PDC thrust bearing, but non-PDC thrust bearings can be used as desired.

FIGS. 5-9 illustrate five stages of controlling the agitator tool 120 according to one embodiment. In stage 1, illustrated in FIG. 5, a dart 510 can be dropped or pumped downhole from the surface when the agitator tool 120 needs to be activated. The dart has a dart body 530 coupled to a dart nose section 540 that comprises one or more openings for fluid flow through the dart 510. A nozzle 520 of the dart 510 disposed in the dart body 530 restricts fluid flow through the dart to the dart nose section 540. The nozzle 520 may be set on the surface to control the frequency of rotation to be performed by the power section 300 of the agitator tool 120, based on the amount of restriction of the fluid flow rate through the bore 360 created by the nozzle 520. The greater the restriction of flow, the faster the rotation of the rotary valve 450 and the higher the frequency of the resulting vibrations. In some embodiments, the nozzle 520 may completely block fluid flow through the bore 360, but generally some flow remains with the dart 510 in place. Until the dart 510 is pumped into the dart catching region 310, fluid flows unrestricted through the bore 360 because of its large size.

Figure 6:
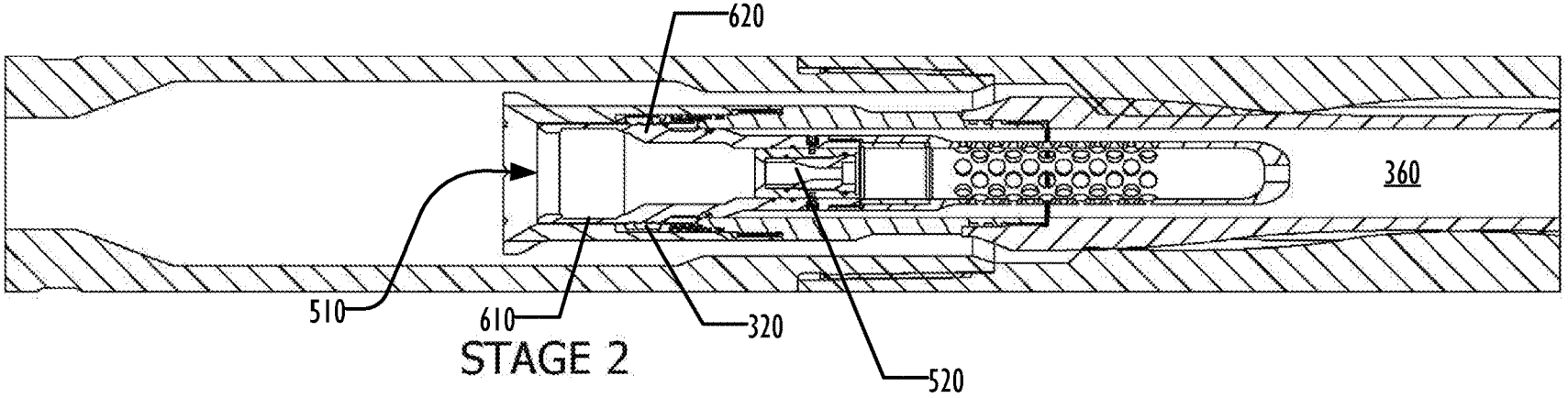

In stage 2, upon engagement with the dart catching region 310, latch profile 620 engages with the locking collets 320 to lock the dart 510 in place. Once the dart 510 has engaged with the locking collets 320, as illustrated in FIG. 6, the nozzle 520 restricts flow through the bore 360, so that fluid flows around the inner mandrel 350, causing rotation of the inner mandrel 350 and driving the valve action described above in the description of FIG. 4. Because an operator may not want the agitator tool 120 to run continuously or may need to reach equipment below the agitator, a groove 610 in the dart 510 allows for wireline retrieval of the dart 510.

Figure 7:
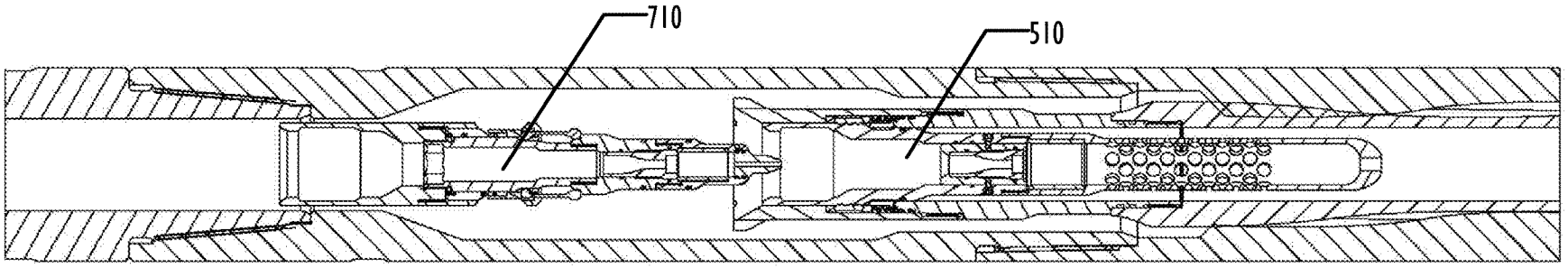

In some situations, an operator having pumped the dart 510 into place as described above may wish to modify the flow through the agitator tool 120 to change the frequency of the vibrations produced. In stage 3, a second dart 710, as illustrated in FIG. 7, may be dropped or pumped into the agitator tool to engage with an uphole end of the dart 510.

Figure 8:
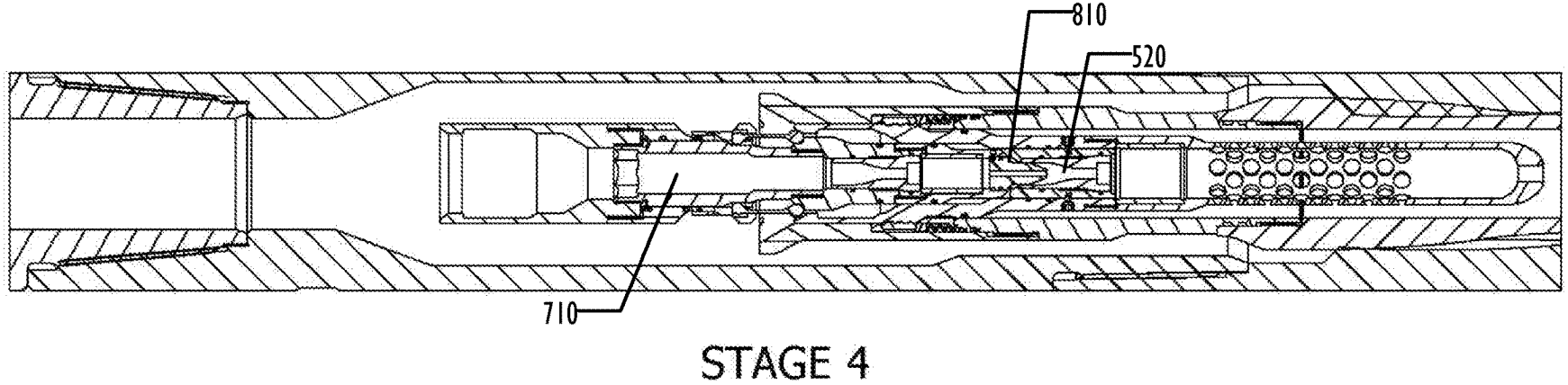

In stage 4, illustrated in FIG. 8, the second dart 710 engages with the dart 510. A nozzle plug 810 of the second dart 710 causes further flow restriction, resulting in a sharp pressure increase shearing a pin in the second dart 710. This causes the nozzle plug 810 to dislodge a carrier for the nozzle 520 from the dart 510, causing the nozzle 520 to flow toward the downhole end of the dart 510.

Figure 9:
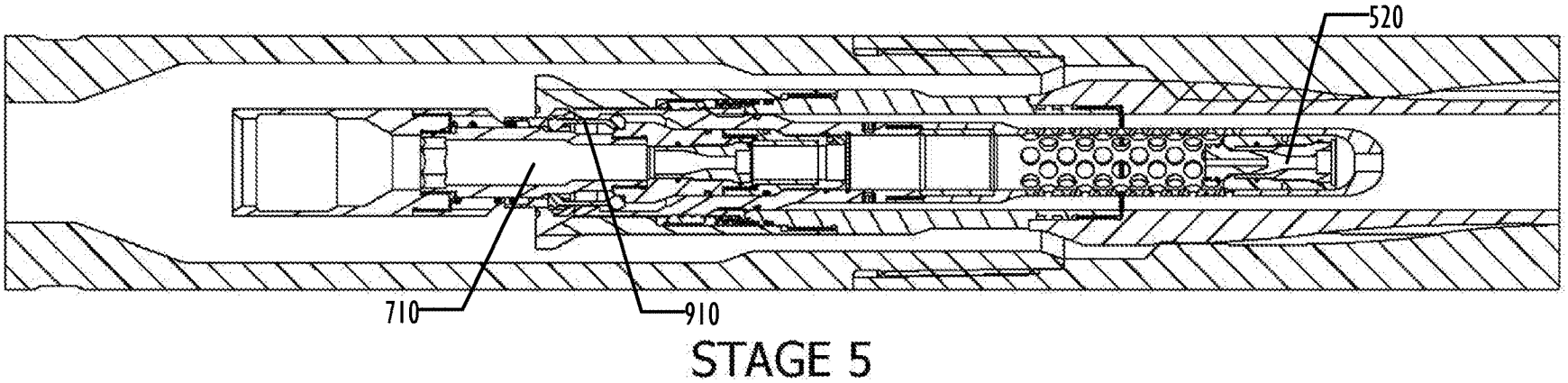

In stage 5, illustrated in FIG. 9, upon engagement with the dart 510, a latch 910 causes the second dart 710 to latch with the dart 510. This allows retrieval of both the dart 510 and the second dart 710 with wireline equipment, with both dart 510 and second dart 710 coming uphole together.

In some scenarios, an operator could run the shock and agitator tool assembly 100 with full fluid flow, then drop a dart 510 to cause the agitator tool 120 to begin vibration, with the dart 510 configured for a predetermined vibration rate or frequency. When agitation is no longer needed, the dart 510 may be withdrawn uphole, returning to full bore fluid flow. A second dart 710 can be used to adjust the vibration frequency, as described above. In addition, the original dart 510 may simply be pulled back uphole and a new dart 510 dropped with the nozzle 520 configured for a different vibration frequency.

The shock and agitator tool assembly 100 may be used as a single sub. Alternately, the agitator tool 120 may be made up by itself in the drill string if the shock tool 110 is not needed. In normal operation, the agitator tool 120 begins with full through bore fluid flow, pumping down a dart 510 only when agitation or vibration of the agitation tool 120 is needed, then returning to full through bore fluid flow when vibration is no longer needed by removing dart 510.

As described above, two darts may be used to control the agitator tool 120. In some embodiments, additional darts can be used, with each successive dart engaging with the previous dart, and further affecting flow through the bore 360 of the power section 300, allowing additional adjustment of the frequency of rotation and thus the vibrations produced in the valve section 400. Each successive dart would be smaller than its predecessor. In one embodiment, the additional dart may seal the first and second darts, fully activating the power section and thus the agitator tool 120. In yet another embodiment, a dart can be pumped into the drill string that causes a breakup up or complete dislodging of the dart 510, allowing the dart 510 to be pumped through the bore 360, restoring full fluid flow through the bore 360.

The large bore 360 of the shock and agitator tool assembly 100 allows use of other tools, such as MWD or well intervention tools, that might not be usable downhole of previous vibration tools that have restricted fluid flow and smaller bores. The vibrations created by the agitator tool 120 do not interfere with MWD operations, and the agitator tool 120 provides a minimal pressure drop until a dart 510 is pumped downhole to engage the agitator tool 120.

In addition, unlike conventional agitator tools, the large bore 360 of the shock and agitator tool assembly 100 would allow an operator to make up a drill string with multiple agitator tools 120, whether separate subs or combined with a shock tool 110 as a shock and agitator tool assembly 100. Each agitator tool 120 in the drill string would have a larger bore 360 than the next agitator tool 120 downhole, so that darts 510 for a desired agitator tool 120 would pass through uphole agitator tools 120, but engage with the dart catching region 310 of the desired agitator tool 120 in the drill string.

Figure 10:
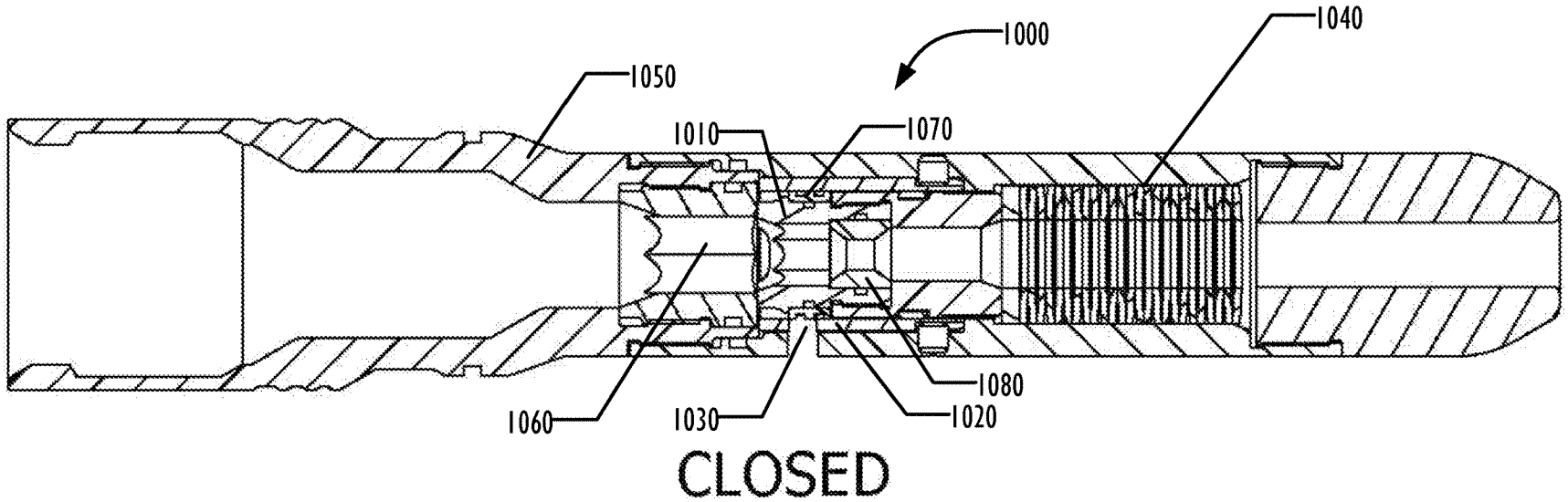
FIGS. 10-11 are plan views illustrating an alternative dart according to one embodiment.
Figure 11:
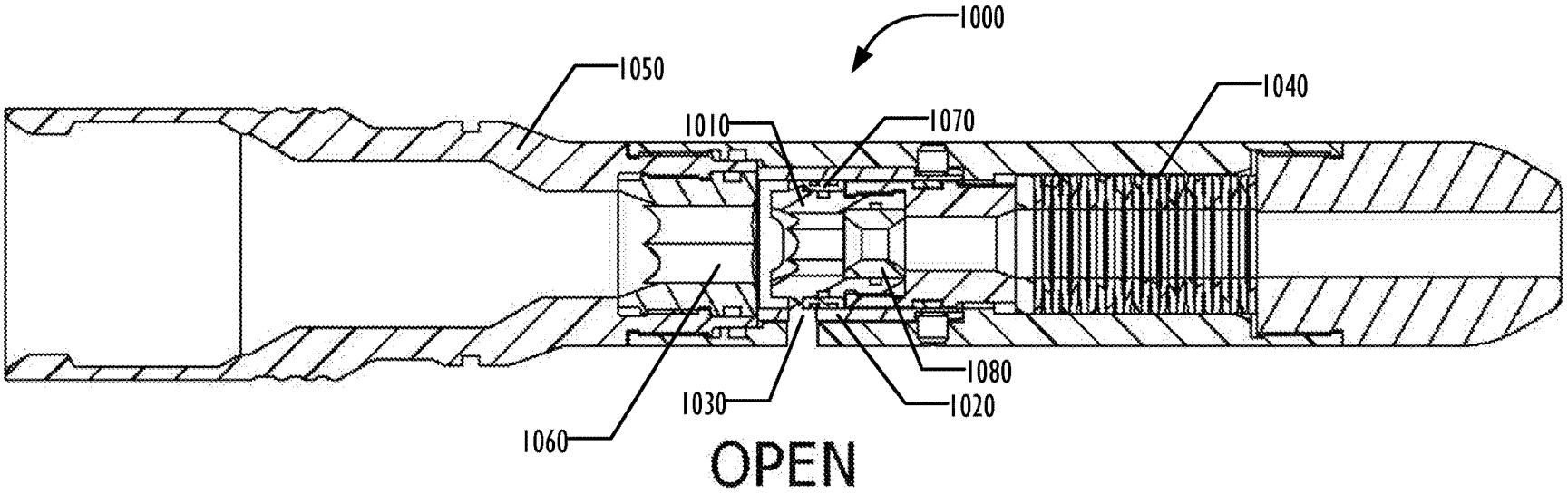

An alternative dart design is shown in FIGS. 10-11. The dart 1000 comprises a nozzle carrier 1010 with an external seal 1070, a seal sleeve 1020 with bypass slots 1030 and a Belleville spring stack 1040 within a dart housing 1050. When in the closed position, as illustrated in FIG. 10, the Belleville spring stack 1040 holds the nozzle carrier 1010 against a retaining nut 1060. This positions the external seal 1070 over the bypass slots 1030, preventing flow from bypassing the nozzle 1080. When in an open position, as illustrated in FIG. 11, the external seal 1070 opens up a portion of the bypass slots 1030.

The movement of the valve carrier 1010 results from a pressure drop due to flow through the nozzle 1080. The spring loading of the Belleville spring stack 1040 may be configured such that the nozzle carrier 1010 remains in a closed position until a sufficient amount of flow passes through the nozzle 1080 to create a net pressure force in the direction of the Belleville spring stack 1040 capable of moving the nozzle carrier 1010 towards an open position. As the external seal 1070 begins to expose the bypass slots 1030, flow progresses through the bypass slots 1030 bypassing the nozzle 1080. As flow rates increase, pressures will increase and further open the bypass slots 1030. The pressure increase will be small relative to the amount of fluid bypassed. The result is the pressure pulse created by the rotary valve 440 is metered by the opening of the bypass slots 1030. This dart arrangement allows for a much larger operating range out of a single dart. A single nozzle size can cover the full range of operating flow rates and densities.

The above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

We claim:

1. A downhole agitator tool for generating controlled vibrations of a drill string, comprising:
- a first dart, comprising:
  - a dart body, open for fluid flow through the first dart;
  - a dart nose section having one or more openings for fluid flow through the first dart, coupled to the dart body; and
  - a dart nozzle disposed in the dart body, configured for a predetermined amount of fluid flow restriction, wherein the dart nozzle is separable from the dart body upon engagement of a second dart with the first dart;
- a valve section, configured for vibration generation, comprising:
  - an outer housing;
  - a driveshaft disposed radially interior to the outer housing, the driveshaft having a through bore and rotatable relative to the outer housing;
  - a driveshaft cap body disposed on an end of the driveshaft, in which are formed a first plurality of ports; and
  - a stationary rotary valve disposed radially exterior to the driveshaft cap body, in which are formed a second plurality of ports longitudinally aligned with the first plurality of ports; and
- a power section, coupled to the valve section, comprising:
  - a stator;
  - a rotor, disposed radially interior to the stator and coupled to the driveshaft; and
  - a dart catching unit, disposed on an uphole end of the rotor, comprising:
    - a guide section forming a guide for receiving the first dart when pumped from uphole; and
    - a locking collet coupled to the guide section and configured to retain the first dart upon engagement,
- wherein the power section rotor is stationary relative to the power section stator unless the first dart is engaged with the dart catching unit.

2. The downhole agitator tool of claim 1,
wherein the dart body comprises a groove configured for wireline retraction of the first dart uphole.

3. The downhole agitator tool of claim 1,
wherein the first plurality of ports comprises 2 ports, and wherein the second plurality of ports comprises 4 ports.

4. The downhole agitator tool of claim 1,
wherein the second dart is configured to latch with the first dart upon engagement with the first dart.

5. The downhole agitator tool of claim 1, wherein the second dart is configured for a predetermined modified fluid flow rate when engaged with the first dart.

6. The downhole agitator tool of claim 1, wherein the first dart and the second dart are retrievable using a wireline tool.

7. The downhole agitator tool of claim 1, wherein the second dart is configured for engagement with a third dart pumped downhole.

8. A shock and agitator tool assembly, comprising:
- a shock tool, comprising:
  - an outer housing;
  - an inner mandrel; and
  - one or more Belleville springs configured to allow axial movement of the inner mandrel relative to the outer housing, wherein the one or more Belleville springs are configured for compression corresponding to a predetermined downhole load; and
- an agitator tool, comprising:
  - a first dart, comprising:
    - a dart body, open for fluid flow through the first dart;
    - a dart nose section having one or more openings for fluid flow through the first dart, coupled to the dart body; and
    - a dart nozzle disposed in the dart body, configured for a predetermined amount of fluid flow restriction,
    - wherein the dart nozzle is separable from the dart body upon engagement of a second dart with the first dart;
  - a valve section, configured for vibration generation, comprising:
    - an outer housing;
    - a driveshaft disposed radially interior to the outer housing, the driveshaft having a through bore and rotatable relative to the outer housing;
    - a driveshaft cap body disposed on an end of the driveshaft, in which are formed a first plurality of ports; and
    - a stationary rotary valve disposed radially exterior to the driveshaft cap body, in which are formed a second plurality of ports longitudinally aligned with the first plurality of ports; and
  - a power section, coupled to the valve section, comprising:
    - a stator;
    - a rotor, disposed radially interior to the stator and coupled to the driveshaft; and
    - a dart catching unit, disposed on an uphole end of the rotor, comprising:
      - a guide section forming a guide for receiving the first dart when pumped from uphole; and
      - a locking collet coupled to the guide section and configured to retain the first dart upon engagement,
    - wherein the power section rotor is stationary relative to the power section stator unless the first dart is engaged with the dart catching unit.

9. The shock and agitator tool assembly of claim 8,
wherein the dart body comprises a groove configured for wireline retraction of the first dart uphole.

10. The shock and agitator tool assembly of claim 8,
wherein the first plurality of ports comprises 2 ports, and wherein the second plurality of ports comprises 4 ports.

11. The shock and agitator tool assembly of claim 8, wherein the second dart is configured to latch with the first dart upon engagement with the first dart.

12. The shock and agitator tool assembly of claim 8, wherein the second dart is configured for a predetermined modified fluid flow rate when engaged with the first dart.

13. The shock and agitator tool assembly of claim 8, wherein the first dart and the second dart are retrievable using a wireline tool.

14. The shock and agitator tool assembly of claim 8, wherein the second dart is configured for engagement with a third dart pumped downhole.

15. A method of controlling a downhole agitator tool, comprising:

flowing drilling fluid through a bore of the agitator tool;

pumping a first dart downhole;

engaging the first dart with a dart catching region of the agitator tool;

reducing drilling fluid flow through the bore by a nozzle of the first dart;

engaging a power section of the agitator tool responsive to engaging the first dart with the dart catching region of the agitator tool;

rotating a rotary valve of the agitator tool by the power section, opening and restricting ports of the rotary valve, causing vibrations in the agitator tool at a predetermined frequency;

pumping a second dart downhole; and engaging the second dart with the first dart, wherein the second dart further modifies drilling fluid flow through the bore.

16. The method of claim 15, further comprising:

retrieving the first dart with a wireline tool; and disengaging the power section responsive to retrieving the first dart.

17. The method of claim 15, wherein engaging the second dart with the first dart comprises:

dislodging a nozzle carrier of the first dart by a nozzle plug of the second dart.

* * * * *